US009638214B2

(12) United States Patent
Hammel et al.

(10) Patent No.: US 9,638,214 B2
(45) Date of Patent: May 2, 2017

(54) BALANCING WEIGHT FOR A FAN WHEEL

(75) Inventors: Christian Hammel, Pfedelbach-Oberohrn (DE); Jürgen Moll, Ilshofen (DE)

(73) Assignee: EBM-PAPST MULFINGEN GMBH & CO. KG, Mulfingen (DE)

( * ) Notice: Subject to any disclaimer, the term of this patent is extended or adjusted under 35 U.S.C. 154(b) by 410 days.

(21) Appl. No.: 14/342,462

(22) PCT Filed: Oct. 12, 2011

(86) PCT No.: PCT/EP2011/067768

§ 371 (c)(1),
(2), (4) Date: Mar. 3, 2014

(87) PCT Pub. No.: WO2013/053387

PCT Pub. Date: Apr. 18, 2013

(65) Prior Publication Data

US 2014/0234106 A1 Aug. 21, 2014

(51) Int. Cl.

| | |
|---|---|
| ***F04D 29/66*** | (2006.01) |
| ***F01D 5/02*** | (2006.01) |
| ***F01D 5/10*** | (2006.01) |
| ***F04D 29/28*** | (2006.01) |

(52) U.S. Cl.
CPC ..... *F04D 29/662* (2013.01); *F01D 5/027* (2013.01); *F01D 5/10* (2013.01); *F04D 29/281* (2013.01)

(58) Field of Classification Search
CPC ..... F01D 5/027; F01D 5/10; F04D 29/662; F04D 29/281
USPC ..... 416/144, 145, 500; 415/119; 24/343, 24/346, 347, 350; 464/180; 74/572.4
See application file for complete search history.

(56) References Cited

U.S. PATENT DOCUMENTS

| | | | | |
|---|---|---|---|---|
| 2,221,747 | A * | 11/1940 | Turner | F16F 15/324 301/5.21 |
| 3,512,222 | A * | 5/1970 | Tinnerman | F16B 5/0607 24/350 |
| 4,043,147 | A * | 8/1977 | Wiebe | F01D 5/027 415/104 |
| 6,481,067 | B2 * | 11/2002 | Lackler | A47C 23/057 24/347 |
| 6,530,747 | B1 * | 3/2003 | Schneider | F04D 29/662 24/350 |
| 6,796,006 | B2 * | 9/2004 | Hansen | F16B 5/065 24/289 |
| 8,459,147 | B2 * | 6/2013 | Harada | F16F 15/34 301/5.21 |

(Continued)

FOREIGN PATENT DOCUMENTS

| | | |
|---|---|---|
| DE | 10 2006 057 087 B3 | 6/2008 |
| DE | 10 2009 007 803 A1 | 11/2009 |

(Continued)

OTHER PUBLICATIONS

PCT International Search Report—Jun. 29, 2012.

*Primary Examiner* — Matthew W Jellett
(74) *Attorney, Agent, or Firm* — Brinks Gilson & Lione

(57) ABSTRACT

A balancing weight to balance a blower wheel. The balancing weight is constructed in two pieces consisting of a spring clip and a supplemental weight. The spring clip features a retaining section for securing on the blower wheel and a receptacle section for mounting the supplemental weight.

9 Claims, 2 Drawing Sheets

(56) References Cited

U.S. PATENT DOCUMENTS

| | | | | |
|---|---|---|---|---|
| 8,631,578 | B2 * | 1/2014 | Glasspoole | F01D 5/027 29/889 |
| 8,807,949 | B2 * | 8/2014 | Hammel | F04D 29/662 416/144 |

FOREIGN PATENT DOCUMENTS

| | | | |
|---|---|---|---|
| DE | 10 2010 011 526 | A1 | 9/2011 |
| EP | 1 256 725 | A1 | 11/2002 |

* cited by examiner

BALANCING WEIGHT FOR A FAN WHEEL

CROSS REFERENCE TO RELATED APPLICATION

This application claims priority to International Application No. PCT/EP2011/067768, filed on Oct. 12, 2011.

FIELD OF THE INVENTION

This invention relates to a balancing weight to balance a blower wheel.

BACKGROUND

Rotors for blowers and fans must be balanced as a rule for practical use in order to guarantee a quiet, oscillation-free operation. For that reason balancing weights are primarily positioned on the outer periphery. The prior art describes several possibilities to do that.

Document DE 10 2009 007 803 A1 describes, in the case of a multi-blade centrifugal fan, a compensating weight with a clamp shape for insertion on an edge area of the fan. This design of a balancing weight has the disadvantage with greatly imbalanced rotors that several weights must be placed next to each other because of the relatively small weight of the individual clamp or clasp. That makes the balancing operation complicated.

DE 10 2010 011 526 A1 also describes a clamp-like balancing weight for a radial fanwheel arrangement which is associated with the same disadvantages as previously described. In addition the fanwheel here has a special design with pocket-shaped recesses in whose regions at least one balancing weight can be mounted.

Another document DE 10 2006 057 087 B3 describes a rotor for a blower, wherein the rotor features special pockets for the insertion of balancing weights.

SUMMARY OF THE INVENTION

The object of this invention is to create a balancing weight for the described application which enables a simple and effective balancing of a blower wheel with little effort.

That is achieved in the invention in accordance with this invention in that the balancing weight is constructed in two parts from a spring clip and a supplemental weight, wherein the spring clip exhibits a retainer section for securing to the blower wheel and a receptacle section to mount the supplemental weight.

Advantageous embodiments of the invention are detailed in the following description.

The invention is based on the individual component parts of the inventive balancing weight, namely the spring clip and the supplemental weight.

The invention enables a very fast and effective balancing. First the spring clip can be simply affixed at any position on the periphery of the blower wheel. The balancing can be optimized by the separate supplemental weight in that supplemental weights differing with respect to their weight or their mass are made available; then the proper supplemental weight can be mounted in the receptacle section of the spring clip. As a result, even larger imbalances can be compensated for with one or a very few inventive balancing weights.

In a preferred embodiment of the invention the spring clip consist of a one-piece, stamped-flexible machined part of a spring steel sheet. The spring clip is hereby usefully so bent in an S-shape that the retaining section is constructed approximately in a U-shape and transitions into another approximately U-shaped receptacle section via a common bar section. The retaining section and the receptacle section then have an opposite orientation with respect to the opening sides. The retaining section is so constructed, in adaptation to the blower wheel, that it can be inserted quickly and simply with a frictional and/or positive lock on any desired circumferential edge of the blower wheel. This enables a balancing at any desired circumferential position on the blower wheel.

In a preferred embodiment, the supplemental weight is constructed as a flat, square-shaped body, especially of a metallic flat material. In the process, the supplemental weight and the receptacle section of the spring clip are so adapted to each other in construction, that the supplemental weight can be separably inserted—and thus be interchangeable—into the receptacle section with a frictional or positive lock. Different weights can be realized in a simple manner by means of various lengths and widths of the supplemental weight.

BRIEF DESCRIPTION OF THE DRAWINGS

The invention will be described more in more detail below on the basis of embodiments depicted in the figures. Shown are.

The same parts in the different figures of the drawing are designated with the same reference signs.

DETAILED DESCRIPTION OF THE INVENTION

Figure 1:
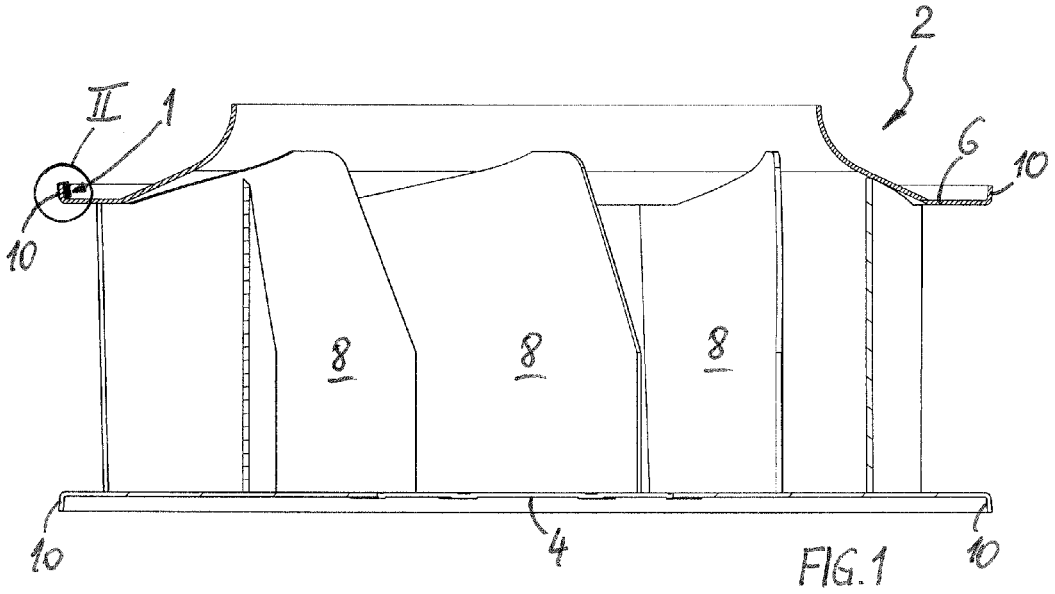
FIG. 1 shows an axially sectioned side view of a possible design of a blower wheel with an inventive balancing weight in Area II.

Depicted in FIG. 1 is a blower wheel 2 for example in the form of a radial rotor, wherein an inventive balancing weight 1 is shown at a circumferential position of the outer periphery. The depicted blower wheel 2 exhibits a base disc 4, a covering disc 6, as well as blades 8 positioned between the base disc 4 and the covering disc 6. The base disc 4 and the covering disc 6 each exhibit in their outer circumferential region a circumferential edge 10 angled in an axial direction or parallel to the axis. The blower wheel 2 consists in particular of aluminum plate or sheet stock with a plate thickness in the range of 1.5 to 6 mm.

The inventive balancing weight 1 will be described in the following using the depictions in FIGS. 2 to 8.

The balancing weight 1 is inventively designed in two parts; it consists of a spring clip 12 and a supplemental weight 14. The spring clip 12 features a retaining section 16 for fixing on the circumferential edge 10 of the covering disc 6 or the base disc 4 of the blower wheel 2, as well as a receptacle section 18 to mount the supplemental weight 14.

Figure 3:
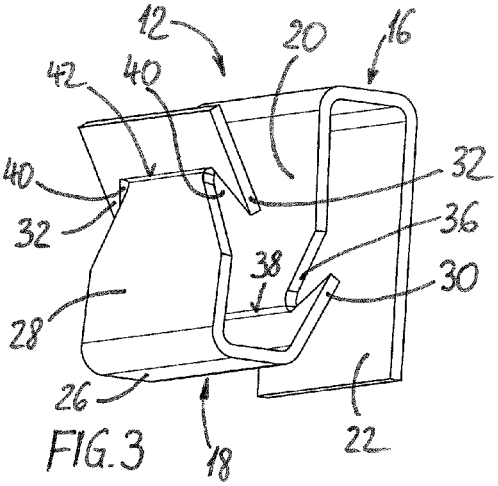
FIG. 3 shows a separate perspective view of a spring clip of the inventive balancing weight.
Figure 4:
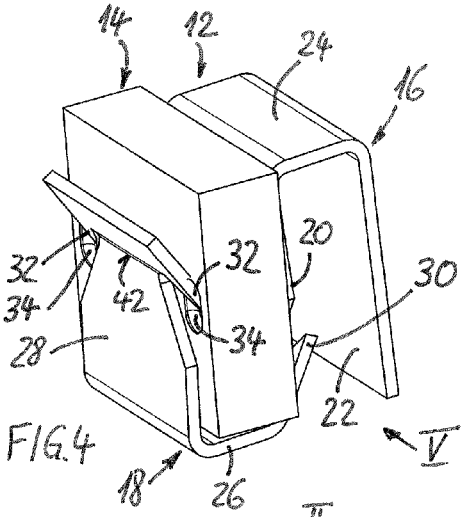
FIG. 4 shows a perspective view of the spring clip with an inserted supplemental weight.
Figure 5:
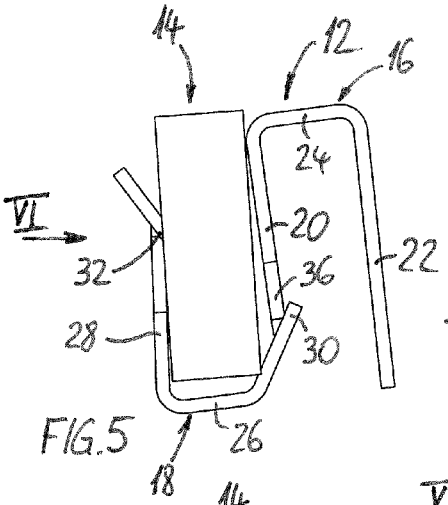
FIG. 5 shows a side view of the complete balancing weight in the direction of the arrow V according to FIG. 4.

As can be best seen in FIG. 3, the spring clip 12 preferably consists of a one-piece, stamped-flexible machined part from a spring-steel sheet in which an originally rectangular plate strip was stamped and appropriately formed. To that end the spring clip 12 is so formed into an approximate S-shape or two opposing U-shapes, that the retaining section 16 is constructed in an approximate (or generally) U-shape and transitions via a common web section 20 into the likewise approximately U-shaped receptacle section 18. The concept "approximate S-shape" or generally S-shaped means the shape consists of flat sections smoothly transitioning into each other via lips. Thus the retaining section 16 is bounded by a flat, exterior holding frame 22, a transition web 24 adjacent thereto, and a common web section 20 adjoining thereto. To form the retaining section 18 an external holding frame 28 connects to the center web section 20 via another transition web 26. Thus the retaining section 16 and the receptacle section 18 are oriented in an opposite manner with respect to the opening directions of their generally U-shaped cross-sections.

Figure 7:
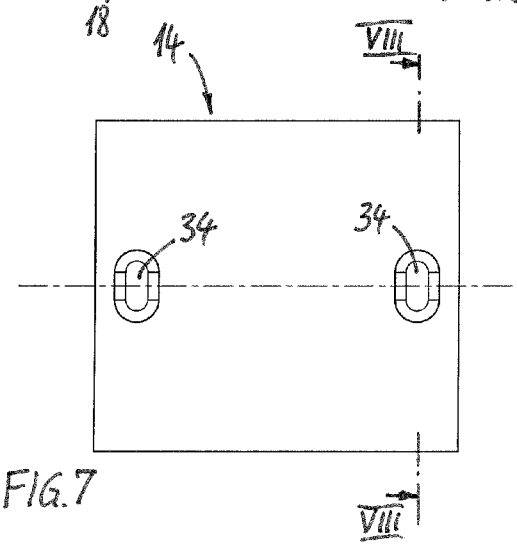
FIG. 7 shows a front view of the inventive supplemental weight.
Figure 8:
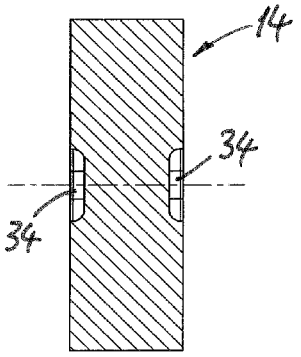
FIG. 8 shows a cross-section through the supplemental weight in the sectional plane VIII-VIII according to FIG. 7.

The inventive supplemental weight 14 is constructed according to FIGS. 7 to 8 preferably as a flat, rectangular body of an in particular metallic flat material.

The retaining section 16 is so constructed with respect to its adaption to the thickness of the circumferential edge 10 of the blower wheel 2, that it can be attached on the circumferential edge 10 with a frictional and/or positive lock. In a similar manner the supplemental weight 14 and the receptacle section 18 of the spring clip 12 are so constructed with respect to adapting to each other, that the supplemental weight 14 can be separably inserted in the receptacle section 18 with a frictional and/or positive lock.

In order to facilitate on the one hand a rapid and simple mounting and on the other hand to guarantee a good and secure mounting, the spring clip 12 exhibits, especially in the side edge areas of the common web section 20, retaining claws 30 tapering to a point and protruding inward into the retaining section 16 for a frictional or positive locking engagement into the material of the circumferential edge 10 of the blower wheel 2. The spring clip 12 also exhibits, especially in the side edge areas of the external holding frame 28 of the receptacle section 18, retaining claws 32 tapering to a point and protruding inward into the receptacle section 18 for a frictional or positive locking engagement into the supplemental weight 14.

In the preferred embodiment that is depicted, the supplemental weight 14 features retaining recesses 34 for a positive engaging of the retaining claws 32 of the spring clip 12. A separation or replacement of the supplemental weight 14 is possible by means of the elastic bending of the holding frame 28 until the retaining claws 32 lie outside the retaining recesses 34, so that the supplemental weight 14 can be removed from the receptacle section 18.

In an especially preferred embodiment the supplemental weight 14 exhibits equal retaining recesses 34 on its two opposite side surfaces; see FIGS. 7 and 8. This design enables the insertion of the supplemental weight 14 in any desired direction, so that during insertion, attention does not have to be paid to a specific direction.

To form the obliquely protruding retaining claws 30 the web section 20 exhibits in the area of its side edges two symmetrical open-edged free punches 36, wherein the web section 20 is so bent at a blunt angle around a bending line 38 running between the two free punches 36, that as a result the retaining claws 30 extend at an angle out of the original plane into the retaining section 16.

The retaining claws 32 are constructed in a similar manner by the two lateral, symmetrical, free punches 40 of the outer holding frame 28, wherein the holding frame is so bent at a blunt angle around a bending line 42 running between the free punches 40, that as a result the retaining claws 32 protrude at an angle out of the original plane of the holding frame 28 into the receptacle section 18.

It should also be mentioned that the supplemental weight 14 can also be constructed without the retaining recesses 34. The pointed, sharp-edged retaining claws 32 would then engage or penetrate slightly into the material, similar to retaining claws 30.

Figure 6:
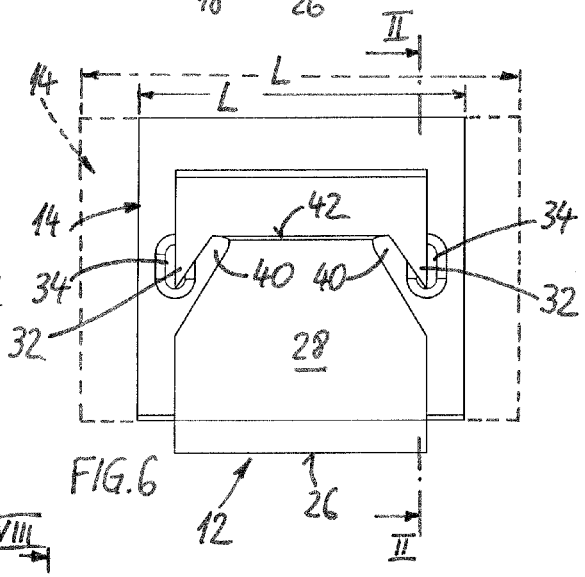
FIG. 6 shows a front view in the direction of the arrow VI according to FIG. 5 wherein a larger supplemental weight is indicated by a dashed line.

As indicated in FIG. 6 various supplemental weights 14 can be held by the spring clip 12. The length L of the supplemental weight 14 is varied in particular in order to vary the weight or the mass.

Figure 2:
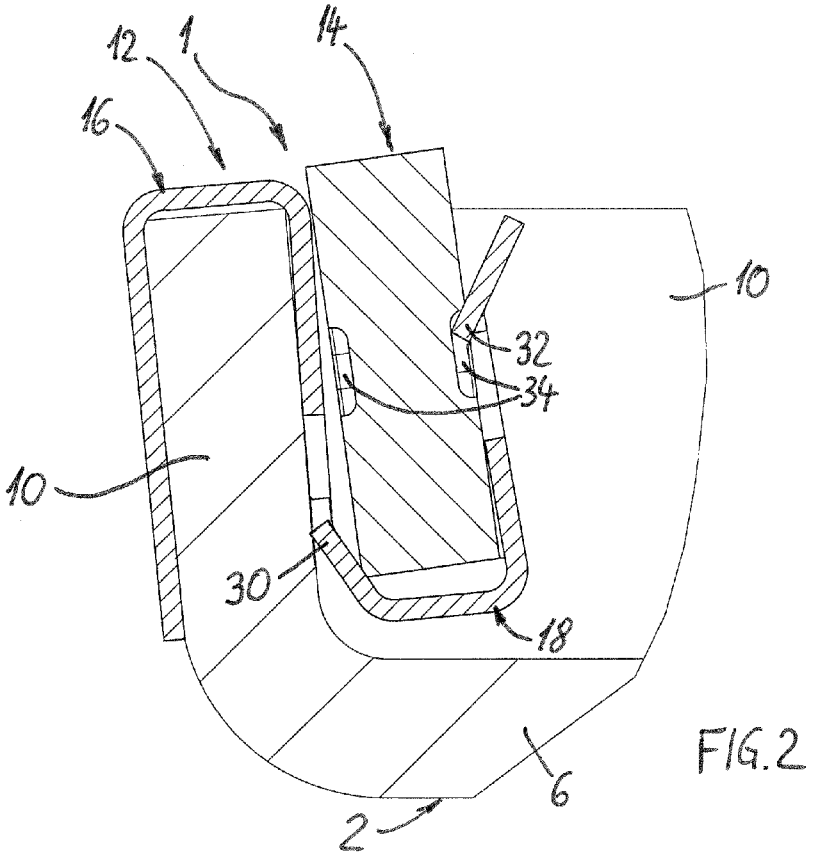
FIG. 2 shows a greatly enlarged view of Area II in FIG. 1 in a section corresponding to the sectional plane II-II in FIG. 6.

To balance the blower wheel 2 the supplemental weight 1 can be fixed in any desired or necessary number at any desired circumferential locations on the covering disc 6 and/or the base disc 4 and it is certainly preferred that the receptacle section 18 with the supplemental weight 14 is positioned on the radial, inward pointing side of the circumferential edge 10 of the base or cover disc 4/6; see FIG. 2. This guarantees a good and secure support of the centrifugal force originating during rotation.

The invention is not limited to the depicted and described embodiments but rather also encompasses all similarly acting embodiments in the sense of the invention. It is expressly emphasized that the embodiments are not limited to all features in combination; on the contrary, each individual partial feature, also separate from all other partial features, can have inventive significance of its own. Furthermore, the invention has not so far been limited to the combination of features defined in the respective independent claim, but can instead be defined by any other combination of specific characteristics of all disclosed, individual features. This means that in essence practically each individual feature of the independent claim can be omitted or can be replaced by at least one individual feature disclosed at another location in the application. Thus all claims are only to be understood as a first attempt at formulation for an invention.

While the above description constitutes the preferred embodiment of the present invention, it will be appreciated that the invention is susceptible to modification, variation and change without departing from the proper scope and fair meaning of the accompanying claims.

The invention claimed is:

1. A balancing weight to balance a blower wheel, comprising, the balancing weight having a two-piece design consisting of a spring clip and a supplemental weight, wherein the spring clip features a means for securing on the blower wheel and a means for mounting the supplemental weight, whereby the spring clip is formed into a S-shape defining a retaining section and a receptacle section, wherein the retaining section is constructed as generally U-shape and transitions via a common web section into a generally U-shaped receptacle section.

2. The balancing weight according to claim 1, further comprising the spring clip in the form of a one-piece element, bent and formed of a spring-steel sheet.

3. The balancing weight according to claim 1, further comprising the supplemental weight in the form of a flat, square-shaped body made of a metallic material.

4. The balancing weight according to claim 1, further comprising the retaining section is configured for attachment to a circumferential edge of the blower wheel with a frictional or a positive lock.

5. The balancing weight according to claim 1, further comprising the receptacle section and the supplemental weight cooperating such that the supplemental weight can be inserted in the receptacle section with a frictional or a positive lock.

6. The balancing weight according to claim 1, further comprising the spring clip in lateral edge areas of the common web section form retaining claws protruding inward into the retaining section to engage in the material of the blower wheel.

7. The balancing weight according to claim 1, further comprising the spring clip at lateral edge areas of an external holding frame of the receptacle section feature retaining claws protruding inward into the receptacle section to engage in the supplemental weight.

8. The balancing weight according to claim 7, further comprising the supplemental weight features retaining recesses for the engagement of the retaining claws of the spring clip.

9. The balancing weight according to claim 8, further comprising the supplemental weight features the retaining recesses on two opposite side surfaces.

* * * * *